United States Patent [19]

Smith et al.

[11] Patent Number: 4,462,714

[45] Date of Patent: Jul. 31, 1984

[54] METHOD AND APPARATUS FOR SETTING A CEMENT PLUG IN THE WIDE-MOUTH SHAFT OF AN EARTH CAVERN

[75] Inventors: Charles F. Smith, Missouri City; George R. Parks, Baytown; Gustavo A. Correa; Ralph N. Holley, both of Houston, all of Tex.

[73] Assignee: The Dow Chemical Company, Midland, Mich.

[21] Appl. No.: 481,703

[22] Filed: Apr. 4, 1983

[51] Int. Cl.[3] ..... E21D 5/00; B65G 5/00

[52] U.S. Cl. ..... 405/55; 166/287; 405/53; 405/133

[58] Field of Search ..... 405/53–59, 405/132, 133; 166/187, 192, 287

[56] References Cited

U.S. PATENT DOCUMENTS

| | | | |
|---|---|---|---|
| 411,981 | 10/1889 | Davis | 166/287 X |
| 1,291,915 | 1/1919 | Kelley | 166/187 X |
| 2,504,462 | 4/1950 | Sprague et al. | 166/187 |
| 2,997,107 | 8/1961 | Lynes | 166/187 X |
| 3,003,322 | 10/1961 | Jordan | 405/59 |
| 3,050,118 | 8/1962 | Elkins | 166/187 X |
| 3,130,787 | 4/1964 | Mason | 166/187 |
| 3,205,665 | 9/1965 | Van Horn | 405/56 |
| 3,307,361 | 3/1967 | Waterman | 405/55 |
| 3,559,409 | 2/1971 | Johnson | 405/57 |
| 4,194,561 | 3/1980 | Stokley et al. | 166/192 X |

FOREIGN PATENT DOCUMENTS

| | | | |
|---|---|---|---|
| 623870 | 1/1936 | Fed. Rep. of Germany | 405/57 |

*Primary Examiner*—Dennis L. Taylor

*Attorney, Agent, or Firm*—V. Dean Clausen

[57] ABSTRACT

The invention disclosed herein is a method and apparatus for setting a cement plug in the wide-mouth shaft of an earth cavern. The apparatus includes a deflated balloon with a liquid fill pipe therein. In practice, the cavern is first filled with a liquid. Following this, the balloon is encased in a releasable girdle and lowered into the cavern through a casing, along with a cement fill pipe which remains above the balloon. When the balloon reaches a certain point in the cavern, below the casing, the girdle is released from the balloon and the balloon is filled with a liquid to inflate it. The inflated balloon seats against the cavern walls to provide an excellent support for the cement, which is pumped down the cement fill pipe.

10 Claims, 7 Drawing Figures

13
16
11a
20
19
18
11
18
10
17
17
13a
12a
14
12a
15
19
12a
12a
12
BRINE
12
12a

METHOD AND APPARATUS FOR SETTING A CEMENT PLUG IN THE WIDE-MOUTH SHAFT OF AN EARTH CAVERN

BACKGROUND OF THE INVENTION

The invention relates generally to a method and apparatus for setting a cement plug in the wide-mouth shaft of an earth cavern. During setting of the cement plug, it is initially supported by a ballon-type structure, which is inflated with a liquid or gas after lowering it into the cavern.

It is common practice to store gases and liquids, for later use, in underground caverns. This technique does not involve the time and expense required to construct storage equipment above ground, and it is a safer mode of storage for many liquids and gases. As an example of underground storage, empty salt caverns are sometimes used for temporary storage of hydrocarbons. After salt is removed from a salt dome, there is a production casing which extends from the earth's surface into the mouth of the cavern. This casing is surrounded by a layer of cement which bonds the casing to the original borehole.

Before the hydrocarbon (usually crude oil, or a petroleum product or chemical) is pumped into a salt cavern, the cavern is filled with brine, through a brine injection pipe which hangs inside the production casing and extends below the casing to a point near the cavern bottom. The hydrocarbon is then pumped into the cavern through the annulus (space) between the production casing and the brine injection pipe. Since the hydrocarbon has a lower density than the brine, it floats on the surface of the brine as a separate phase. When it is desired to withdraw the hydrocarbon for use, more brine is pumped down the injection pipe to raise the brine level in the cavern. As the brine level rises, it displaces an equivalent volume of the hydrocarbon, which is carried up to the surface through the casing annulus.

In some salt caverns, the removal of liquids, such as hydrocarbons, causes a substantial part of the casing cement layer and the salt formation next to the cement layer to be eroded away. The erosion is caused partly by turbulence created in withdrawing the hydrocarbon from the cavern, and partly from using brine which is not salt saturated to displace the hydrocarbon. Saturated brine is a solution containing about 37 percent by weight salt. When a less concentrated brine is used, the salt defining the cavern walls tends to migrate into the brine solution to satisfy the saturated condition. As the erosion progresses, a substantial part of the lower end of the production casing is left hanging in the cavern in an unsupported condition. The unsupported condition is remedied by periodically cutting off the lower end of the casing to shorten it. If the erosion is not halted, it can eventually reach a point where there is danger of the hydrocarbon polluting the potable water aquifers in the rock strata above the cavern.

It is believed that the erosion problem can be overcome by sealing off part of the mouth of the salt cavern below the end of the existing production casing with a solid plug of cement. A hole is then drilled through the cement plug into the cavern and a new production casing is cemented into the hole to provide means for storing and retrieving liquids or gases from the cavern. Heretofore, it has not been possible to perform the type of cementing job which is required. The known tools used in downhole cementing operations, which include inflatable packers, are not designed for supporting the cement plug in the wide-mouth shaft of an earth cavern.

SUMMARY OF THE INVENTION

The invention provides a method and apparatus for setting a cement plug in the wide-mouth shaft of an earth cavern. In one embodiment of the invention, a fluid fill pipe is installed inside an inflatable receptacle while the receptacle is in a deflated condition. The fill pipe has an open end which is positioned inside the deflated receptacle. The cavern is then filled with a fluid and the deflated receptacle is lowered into the cavern through a substantially vertical casing, the casing extending from the earth's surface into the mouth of the cavern. Pipe sections are coupled to the fluid fill pipe to extend it as the deflated receptacle is lowered into the cavern. At the same time, a cement fill pipe is lowered through the casing in an adjacent position to the fluid fill pipe, such that the lower end of the cement fill pipe is positioned above the receptacle.

When the deflated receptacle reaches a certain point in the casing, a packer tool is installed on the fluid fill pipe and cement pipe above the receptacle. The receptacle and packer tool are further lowered through the casing until the packer tool reaches a point near the lower end of the casing. The packer tool is set against the casing and the receptacle is filled with enough fluid to cause it to inflate and seat against the sides of the cavern. Cement slurry is then passed down the cement fill pipe in sufficient quantity to fill that part of the cavern between the top of the receptacle and the bottom of the casing. As the cement hardens, it provides a solid plug in the mouth of the cavern.

The next step is to drill a hole through the cement plug to a point just above the inflated receptacle. A second casing, which provides a new production casing, is then lowered into the drilled hole through the original production casing and it is cemented to the hole and the original casing. Following this, drilling is continued below the end of the new production casing until the drill breaks through the cement plug and ruptures the inflated receptacle. Thereafter, the cavern can be further prepared for storing liquids or gases, as explained later in this specification.

DESCRIPTION OF THE INVENTION

Figure 1:
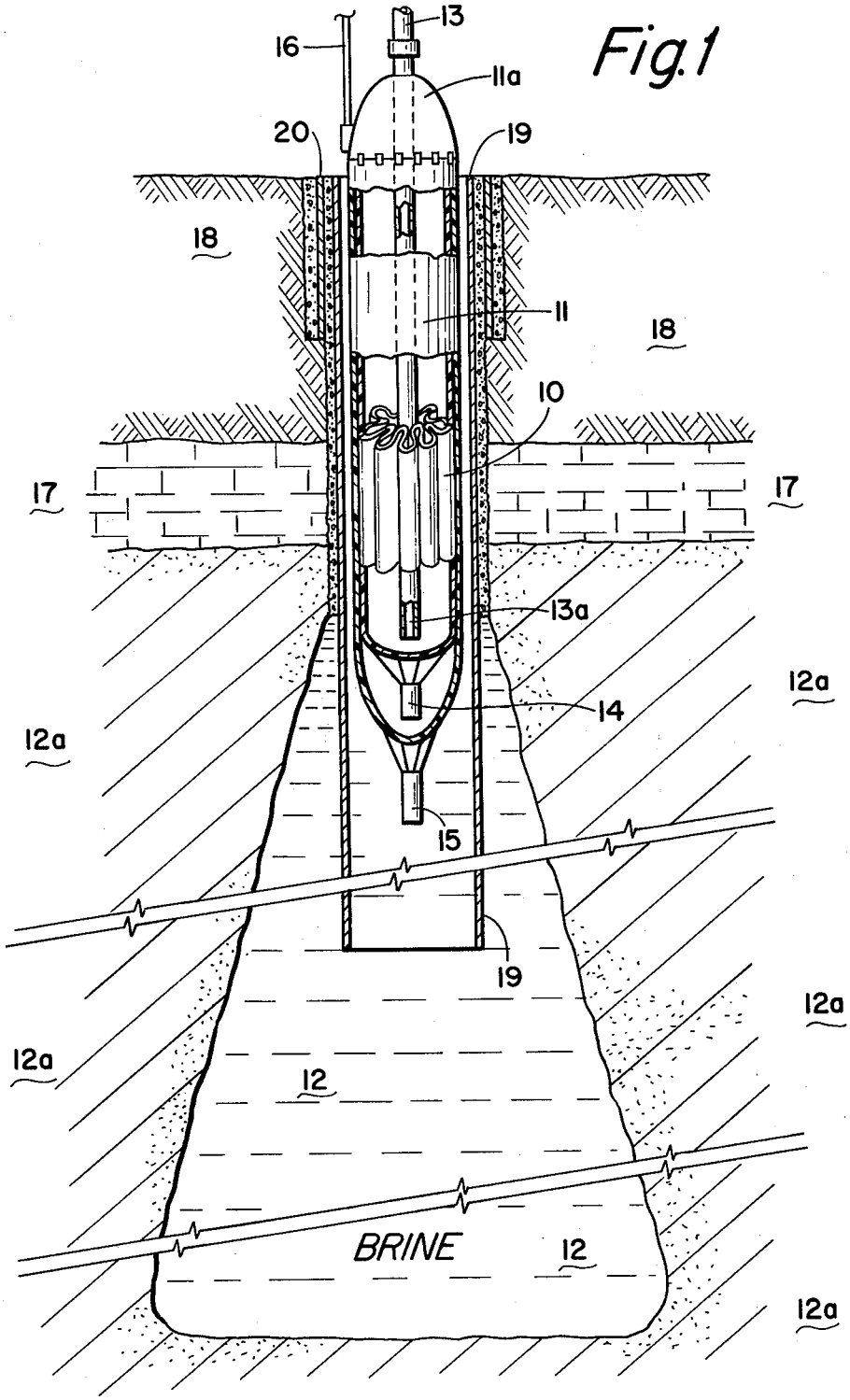
FIG. 1 is a schematic view of a deflated balloon which is encased in a protective girdle. The girdle and balloon assembly are shown being lowered into the wide-mouth shaft of an earth cavern to provide a cement support system according to the practice of this invention.

The practice of this invention involves the setting of a cement plug in the wide-mouth shaft of an earth cavern. The invention is illustrated herein by describing one embodiment for setting a cement plug in the wide-mouth shaft of a salt cavern. Referring first to FIG. 1, there is shown an apparatus for supporting the cement plug. The support apparatus comprises a receptacle 10, which is encased in a girdle member. The girdle is a two-piece structure, which includes a body part 11 with a detachable cap 11*a* fastened to the top of the body. The receptacle 10 is a balloon-type structure, preferably fabricated of a synthetic material.

As shown in FIG. 1, the balloon 10 is in a deflated condition prior to lowering it into the salt cavern 12. A fill pipe 13 is installed inside the balloon. The bottom end of the fill pipe 13, indicated by numeral 13*a*, is open, so that the balloon can be filled with a fluid to inflate it. Attached to the bottom end of balloon 10 is a weight 14, which acts as a ballast during lowering of the balloon into the cavern. A similar ballast weight 15 is attached to the bottom end of the girdle body 11. A release line 16 is secured to the detachable cap 11*a* of the girdle. The cap itself is attached to the body 11 of the girdle by any of various fastening means, such as frangible clips, designed to break when a given force is applied to the cap by yanking upwardly on the release line.

Referring further to FIG. 1, the cavern 12 is defined within a salt formation indicated generally by numeral 12*a*. Above the salt formation is a rock strata 17, which contains potable water aquifers (not shown). Overlying the rock strata is a layer of earth, generally indicated by numeral 18. Prior to the cementing operation described herein, salt was removed from the cavern through a production casing 19, which was cemented into the original "access" borehole. The production casing is enclosed by and cemented to a surface casing 20, which was placed prior to the production casing.

As described earlier, after the salt was removed to create the cavern 12, a hydrocarbon liquid was stored in the empty cavern. Later, when the hydrocarbon was withdrawn from the cavern, it caused a substantial part of the cement layer around the production casing 19, and part of the adjacent salt face 12*a* to erode away. To prevent possible pollution of the water aquifers, therefore, the present invention provides a method for sealing off the wide-mouth shaft of the cavern with a cement plug. At the start of the cementing operation, the cavern 12 is first filled with a saturated brine solution. The preferred solution contains about 10.2 to 10.5 ppg (lbs brine/gal of water).

Figure 2:
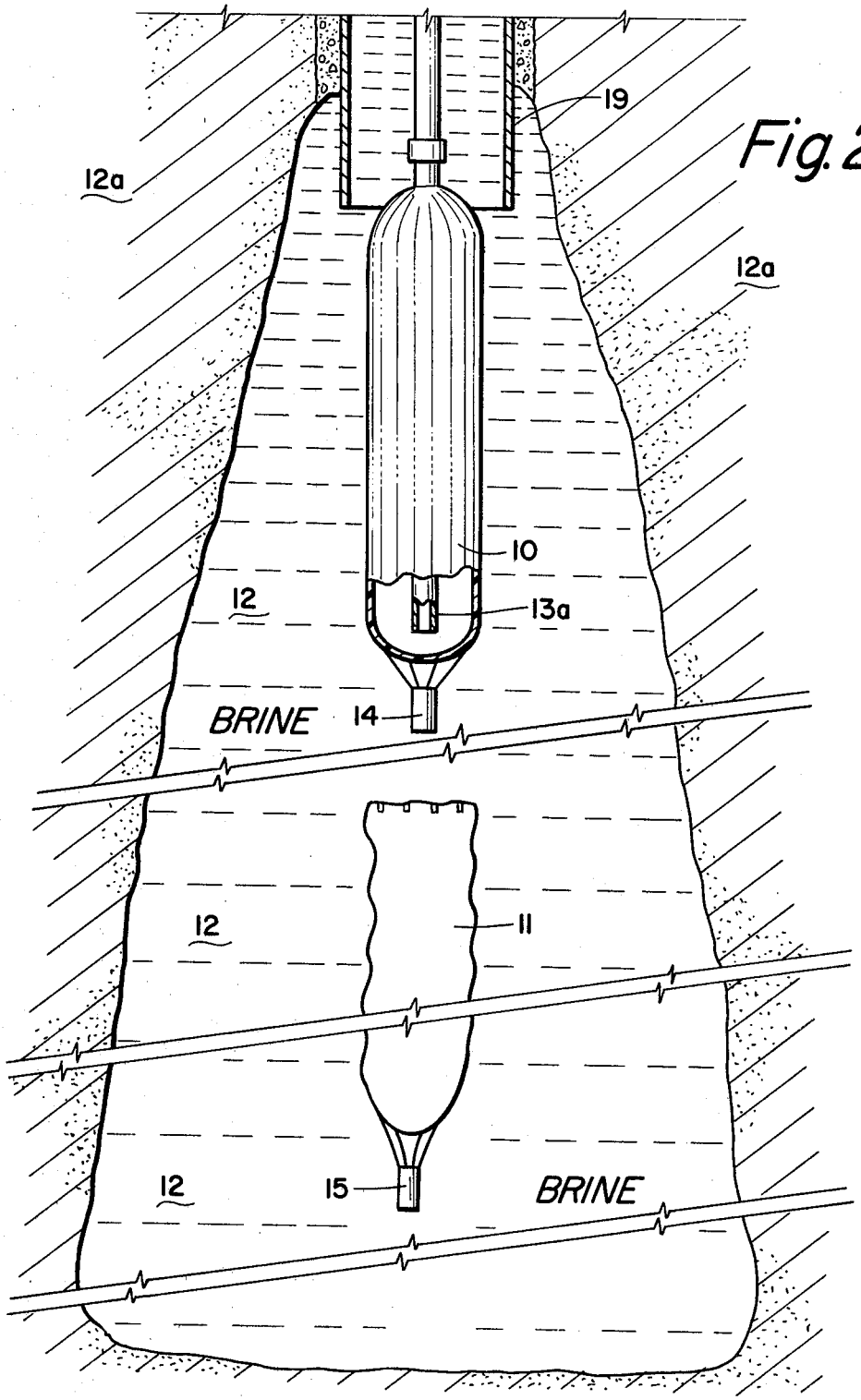
FIG. 2 is a schematic view illustrating the step of releasing the girdle from the deflated balloon, in preparing the balloon for inflation.

The next step, as illustrated in FIG. 1, is to lower the balloon and girdle assembly through casing 19 toward the brine-filled cavern 12. During lowering of the balloon and girdle, which is done from a rig structure at the earth's surface (not shown), the liquid fill pipe 13 is lengthened by adding one pipe section at a time at the rig structure. A cement fill pipe 21 (note FIG. 3) is lowered through the casing 19, along with the liquid fill pipe 13 and in a position adjacent to the liquid fill pipe. When the balloon and girdle assembly reaches a point near the bottom end of casing 19, as shown in FIG. 2, the release line 16 is pulled upwardly from the surface rig structure. This action severs the girdle cap 11*a* from the body 11, so that the body 11 drops away from the deflated balloon 10 and is pulled toward the cavern bottom by the ballast weight 15.

Figure 3:
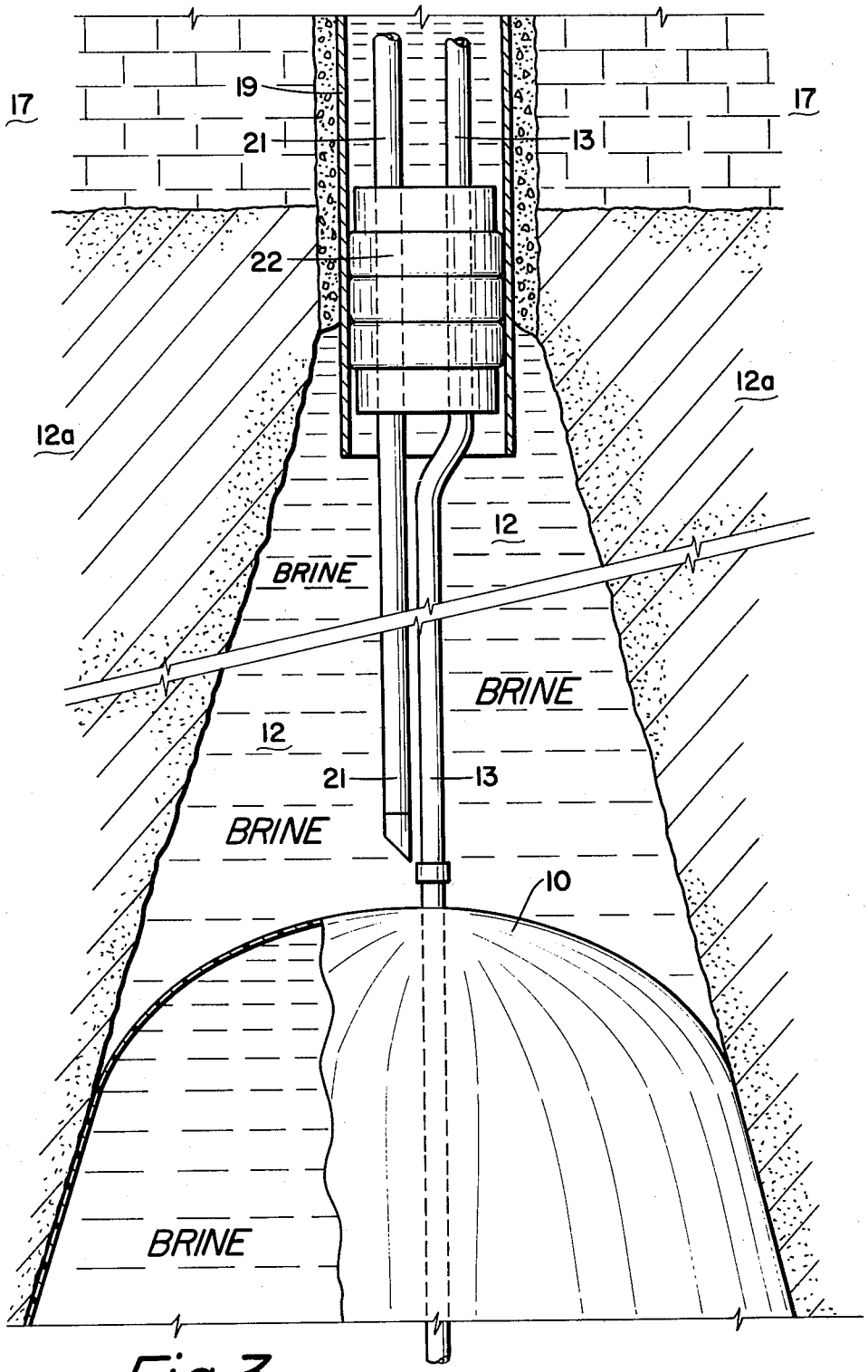
FIG. 3 is a schematic view illustrating a packer tool which is installed on the cement fill pipe and liquid fill pipe above the inflated balloon. In this view, the packer tool is in its set position in a production casing through which the balloon is lowered into the cavern.

The next step is to install packer tool 22 on the liquid fill pipe 13 and the cement fill pipe 21 at the surface. The packer tool is installed on the fill pipes at a given distance above the balloon 10. The point at which the packer tool is installed is determined primarily by the length of the cement plug in the cavern. Referring to FIG. 3, after the packer is installed, the deflated balloon 10 is further lowered into the brine-filled cavern 12 until it reaches a point where it is desired to place the first stage of the cement plug. When the balloon reaches this point in the cavern, the packer 22 will be positioned near the lower end of the casing 19. The packer is then set against the casing 19 in preparation for inflating the balloon 10.

A brine solution is then pumped down the fill pipe 13 to inflate the balloon. As the balloon expands, it seats against the walls of the cavern, as shown in FIG. 3. In the practice of this invention, the ballon is filled with brine of a slightly lower density than the brine which was pumped into the cavern 12. Typically, the brine used to inflate the balloon should have a density of about 10 ppg, or about 0.2 ppg less than the density of the brine in the cavern. Filling the balloon with a lower density brine gives it a slight buoyancy in the brine occupying the cavern. The buoyancy effect, combined with friction exerted by the inflated balloon against the walls of the cavern, provides a good support structure for the cement plug.

The ability of the balloon to support the cement plug is further enhanced by inducing a hydrostatic pressure inside the balloon which is slightly higher than the hydrostatic pressure exerted by the (cavern) brine in which the balloon is suspended. In practice, the hydrostatic pressure inside the balloon is about 2 psi higher than the hydrostatic pressure of the brine surrounding the balloon. The higher pressure condition in the balloon is achieved by extending the height of the brine fill pipe 13 a given distance above the surface level of the brine in casing 19. The actual distance which the fill pipe 13 must be extended above the brine level in the casing is calculated by employing known engineering procedures for calculating a hydrostatic head pressure. According to this invention, the rupture pressure of the balloon 10 is about 4 psi, so that the induced pressure of 2 psi inside the balloon is well within this limit.

Figure 4:
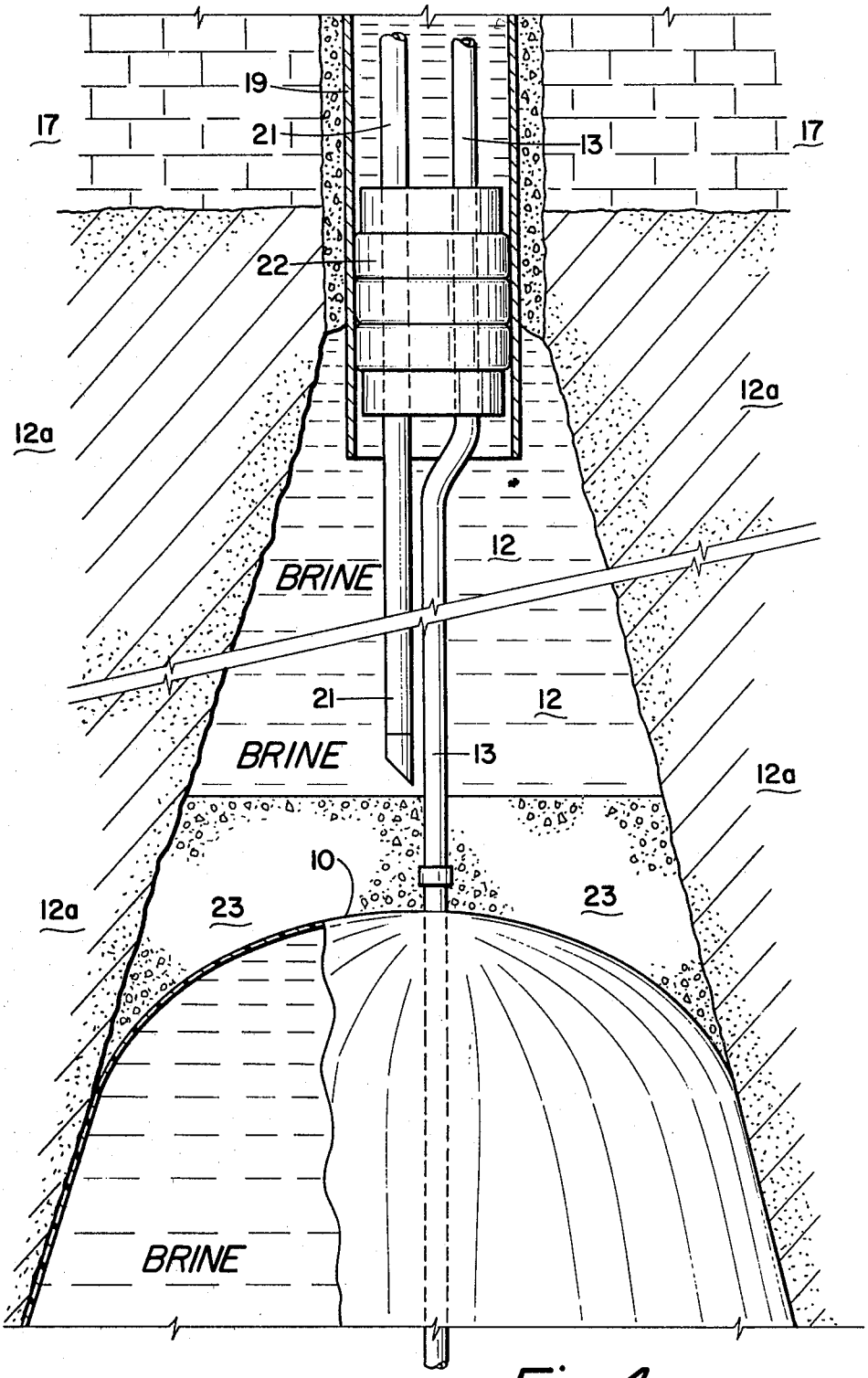
FIG. 4 is a schematic view illustrating placement of the first stage of a cement plug in the cavern.

According to this invention, the cement plug can be set in several stages or as a single stage. The primary factor which determines whether the cementing operation is conducted in more than one stage is the size of the cavern area to be cemented. In the embodiment of the invention described herein, the cementing operation is carried out in several stages. Referring now to FIG. 4, a sufficient amount of cement slurry for the first stage is passed down the cement fill pipe 21, so that it fills a section of the cavern immediately above the inflated balloon 10. Before the cement hardens, the fill pipe 21 is pulled upwardly, so that it is a short distance above the cemented section. The cement slurry is then allowed to harden over a period of 24 to 72 hours, to provide the first stage 23 of the cement plug.

Figure 5:
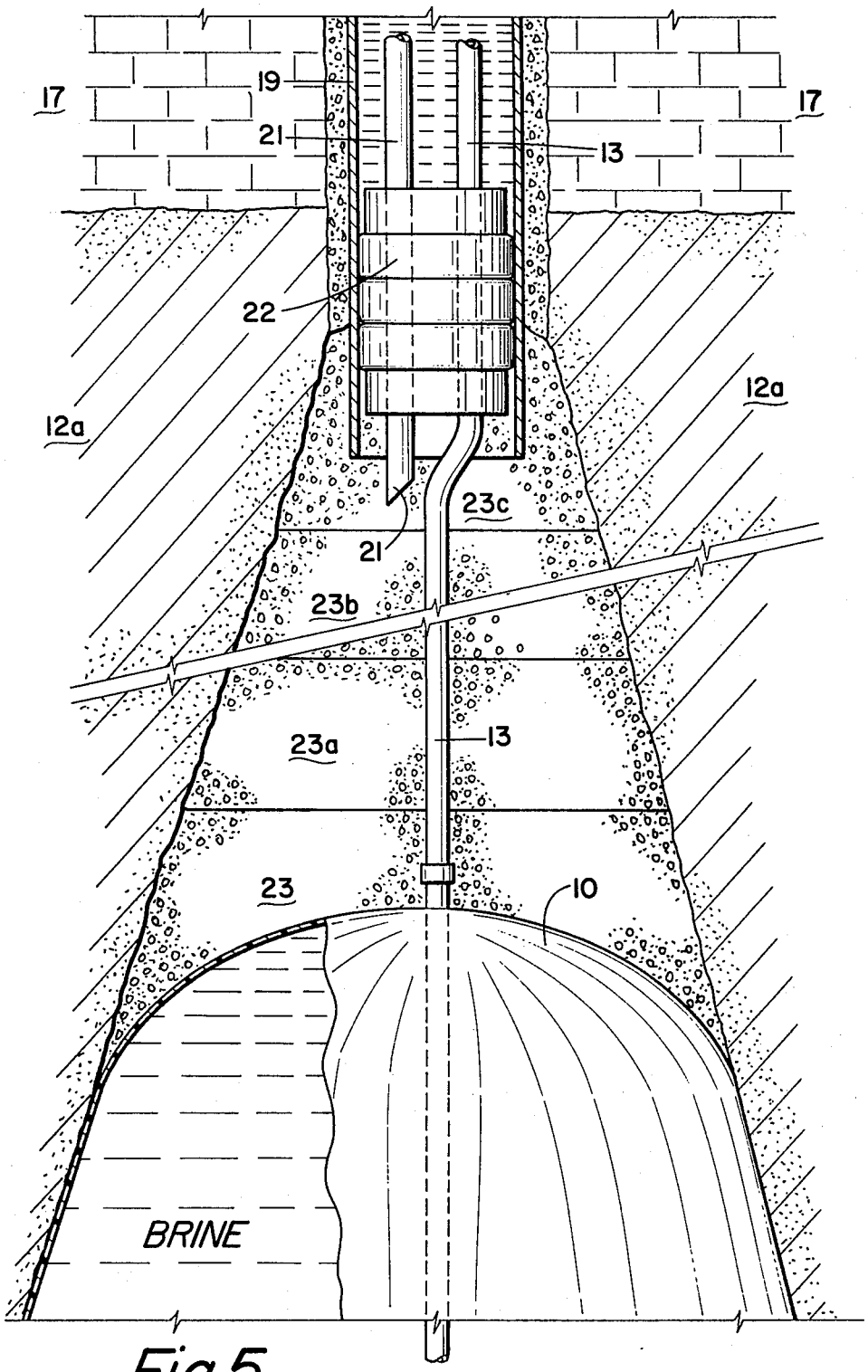
FIG. 5 is a schematic view illustrating placement of additional stages of the cement plug, above the first stage, to complete the cementing operation.

Referring to FIG. 5, additional stages of the cement slurry are poured, by repeating the procedure described above, until the cement plug completely fills the section of the cavern between the top of balloon 10 and the bottom end of the production casing 19. The additional stages above the first stage are indicated by numerals 23*a*, 23*b*, and 23*c*. During each stage of the cementing operation, as the cement flows into the cavern from the fill pipe 21, it displaces an equivalent volume of brine from the cavern. The brine displaced from the cavern 12 is pushed upwardly through a bypass (not shown) in the packer 22 and is carried to the surface through the production casing 19.

Following the cementing operation, the cement fill pipe 21 and liquid fill pipe 13 are disconnected from the packer 22 and then pulled out of the casing 19. The pipes are disconnected from the packer by cutting them above the packer, or by releasing them from the packer in a conventional manner. This leaves the packer 22 in its set position in casing 19 and the lower end of each of the fill pipes 13 and 21 remains in the cement plug, as indicated in FIG. 5. As an alternative procedure, which is not illustrated herein, the liquid fill pipe 13 can be disconnected from the packer 22 after the first stage 23 of the cement plug has been completed.

Figure 6:
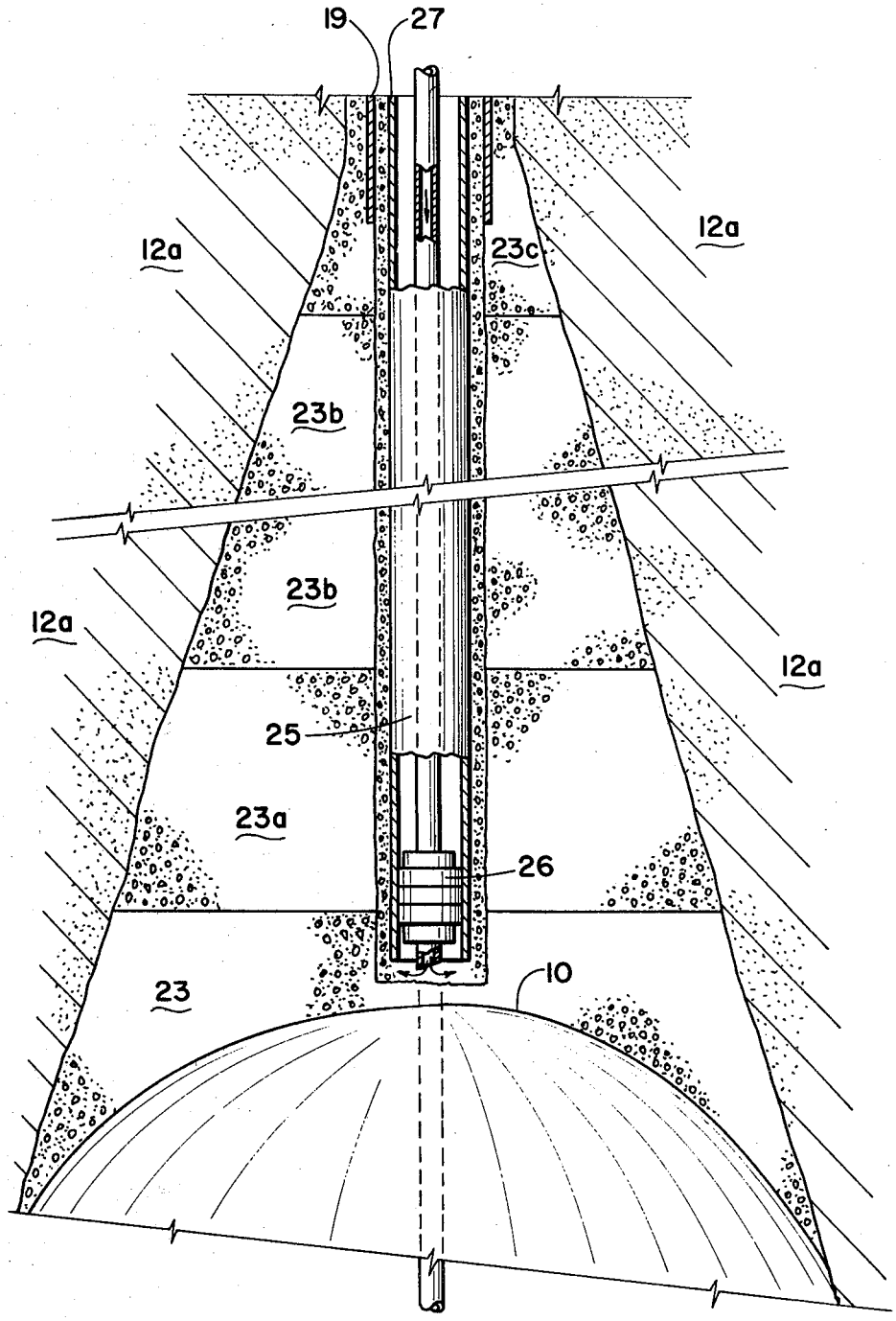
FIG. 6 is a schematic view which illustrates the step of drilling through the cement plug and cementing a new production casing into the drilled hole and the original production casing.

Referring now to FIG. 6, the next step is to drill through the cement plug to a point just above the inflated balloon 10. A second casing 25, which provides a new production casing, is then lowered into the drilled hole 24 through the original production casing 19. A packer 26 on tubing string 27 is then lowered into casing 25 and set into the casing at the lower end. After the packer is set, cement is pumped down the tubing string to cement the casing 25 into the drilled hole 24 and to bond to the original casing 19.

Figure 7:
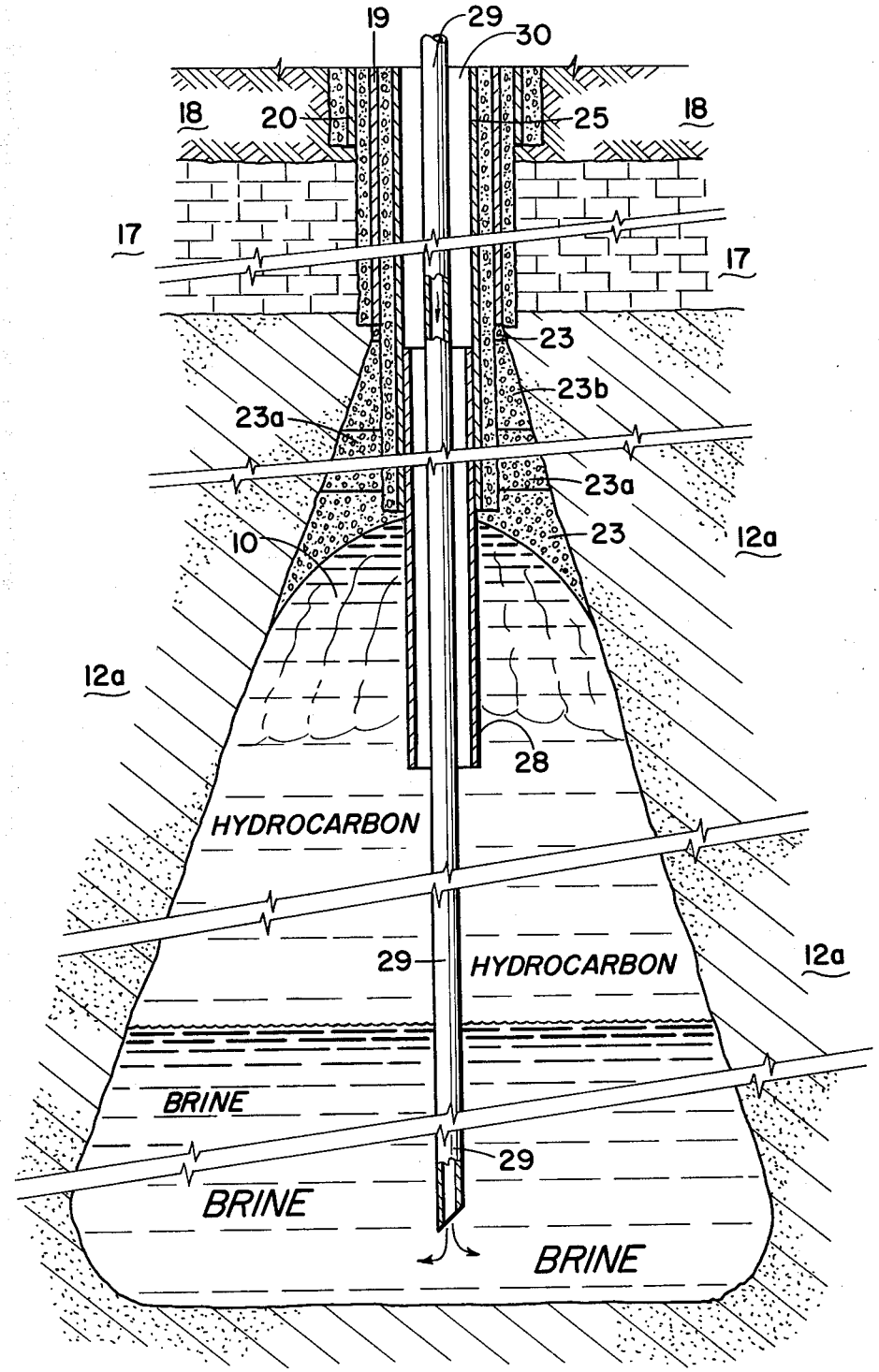
FIG. 7 is a schematic view illustrating the appearance of the cavern after the inflated balloon has been ruptured and additional steps have been taken to prepare the cavern for storage of liquids or gases.

Referring to FIG. 7, after the new production casing 25 is cemented into place, the cavern 12 can be prepared for storage of liquids or gases. The first step is to pull the tubing string 27 and packer 26 out of casing 25 and lower a drill to the bottom end of the casing. The drill is pushed through the cement "bridge" below the end of casing 25 until it hits the inflated balloon 10 and ruptures it. As illustrated in FIG. 7, the ruptured balloon collapses against the walls of cavern 12.

In some storage operations it may be desirable to install a short section of casing 28 at the lower end of the casing 25, so that the short casing extends into the cavern beyond the end of the ruptured balloon 10. The purpose of the short casing is to prevent the fragmented balloon from plugging off the casing 25 during withdrawal of materials from the cavern. Installation of the short casing 28 is considered an optional step and not a critical requirement, in that the problem described above may not arise in all storage and withdrawal operations.

The next step in preparing the cavern as a storage site is to hang an injector pipe 29 inside the new production casing 25 (and the short casing 28 if used). The bottom end of pipe 29 will be positioned a short distance above the cavern floor, as shown in FIG. 7. Following this step, the salt cavern 12 is ready for the storage of various hydrocarbons. Referring further to FIG. 7, a procedure for storing a liquid hydrocarbon in the cavern is described. The hydrocarbon is first pumped down the annulus 30 between the injector pipe 29 and casing 25, thus displacing any equivalent volume of brine which is carried to the surface through the injector pipe 29. During its storage in the salt cavern 12, the hydrocarbon floats on the surface of the brine as a separate phase. To withdraw the hydrocarbon, brine is pumped down the injector pipe 29 to displace the hydrocarbon, which is carried to the surface through the annulus 30.

General details relating to the practice of this invention will now be discussed. Broadly, the method and apparatus of this invention are useful for setting a cement plug in any of various wide-mouth shafts of earth caverns, such as the salt cavern described and illustrated herein. Generally speaking, a wide-mouth shaft of a cavern can be considered one in which the shaft is at least six feet wide. In those caverns where the cementing operation is conducted in several stages, it is preferred to use an ultra light weight cement for the first stage and sometimes the second stage.

Light weight cement compositions employed in the practice of this invention have densities in the range of about 10.2 to 10.4 ppg (lbs cement/gal water). These cement compositions are commercially available from Dowell Division of The Dow Chemical Company. For the cement stages above the second stage, it is preferred to use heavier cement compositions of the type used in conventional well servicing operations. The purpose of using the light weight cement compositions in the first and second stages is to provide a structure which is strong enough to be self-supporting, but light enough to exert a much lower stress on the balloon 10 than the heavier cement compositions. The balloon 10 is fabricated of a synthetic elastomer material. The preferred fabric is nylon (12 oz/sq yd), which is coated on both sides to provide a fabric weight of about 38 oz/sq yd.

The invention claimed is:

1. Method for setting a cement plug in the wide-mouth shaft of an earth cavern, comprising the steps of:

(a) filling the cavern with a fluid;

(b) installing a fluid fill pipe inside an elongate, inflatable receptacle, the receptacle is in a deflated condition, and the fill pipe has an open end positioned within the deflated receptacle;

(c) lowering the deflated receptacle into the cavern through a substantially vertical first casing, the top end of the casing is at the earth's surface, and the bottom end is at the mouth of the cavern;

(d) extending the length of the fluid fill pipe as the deflated receptacle is being lowered, and simultaneously lowering a cement fill pipe through the first casing, the cement fill pipe is adjacent to the fluid fill pipe, and the lower end of said pipe is positioned above the receptacle;

(e) holding the deflated receptacle at a first predetermined point in the first casing during the lowering step;

(f) installing a packer tool on the fluid fill pipe and the cement fill pipe, at the earth's surface, as the deflated receptacle is being held at the first predetermined point;

(g) continuing to lower the receptacle and packer tool until the receptacle reaches a second predetermined point below the lower end of the first casing, at which point the packer tool is positioned above the lower end of the first casing;

(h) setting the packer tool against the first casing;

(i) filling the receptacle, through the fluid fill pipe, with enough fluid to cause it to inflate and seat against the sides of the earth cavern;

(j) passing a given amount of cement slurry down the cement fill pipe, such that the cement fills that part of the cavern defined between the top of the receptacle and the bottom end of the first casing;

(k) pulling the cement fill pipe out of the first casing, while the cement slurry is wet;
(l) allowing the cement slurry to harden, to define a cement plug in the cavern;
(m) drilling into the cement plug and terminating the drilled hole above the inflated receptacle;
(n) lowering a second casing into the first casing, such that the top end of the second casing is at the earth's surface and the bottom end is above the bottom end of the drilled hole;
(o) cementing the second casing to the drilled hole and to the first casing; and
(p) drilling through the cement plug below the bottom end of the second casing until the drill contacts the inflated receptacle and ruptures said receptacle.

2. Method for setting a cement plug in the wide-mouth shaft of an earth cavern, comprising the steps of:
(a) filling the cavern with a liquid;
(b) installing a liquid fill pipe inside an elongate, inflatable receptacle, the receptacle is in a deflated condition, and the fill pipe has an open end positioned within the deflated receptacle;
(c) encasing the deflated receptacle in a girdle member, which includes a girdle body and a detachable cap fastened to the body;
(d) securing a release means to the detachable cap;
(e) lowering the girdle member and deflated receptacle into the cavern through a substantially vertical first casing, the top end of the casing is at the earth's surface, and the bottom end is at the mouth of the cavern;
(f) extending the length of the liquid fill pipe as the girdle member and deflated receptacle are being lowered, and simultaneously lowering a cement fill pipe through the first casing, the cement fill pipe is adjacent to the liquid fill pipe, and the lower end of said pipe is positioned above the girdle cap;
(g) holding the girdle member and deflated receptacle at a first predetermined point in the first casing during the lowering step;
(h) installing a packer tool on the liquid fill pipe and the cement fill pipe, at the earth's surface, as the girdle member and deflated receptacle are being held at the first predetermined point;
(i) operating the release means, from the earth's surface, to sever the detachable cap from the girdle body;
(j) allowing the girdle body to drop away from the deflated receptacle and drift downwardly toward the cavern floor;
(k) continuing to lower the deflated receptacle, and the packer tool, until the deflated receptacle reaches a second predetermined point below the lower end of the first casing, at which point the packer tool is positioned above the lower end of the first casing;
(l) setting the packer tool against the first casing;
(m) filling the receptacle through the liquid fill pipe, with enough liquid to cause it to inflate and seat against the sides of the earth cavern, the fill liquid has a density less than the liquid in the earth cavern;
(n) passing a given amount of cement slurry down the cement fill pipe, such that the cement fills a section of the cavern above the inflated receptacle and the receptacle supports the cement;
(o) pulling the cement fill pipe upwardly, while the cement slurry is wet, to a point above the cemented section;
(p) allowing the cement slurry to harden, to define the first stage of a cement plug in the cavern;
(q) repeating steps (n), (o), and (p), to provide additional stages of the cement plug above the first stage, until said plug completely fills that part of the cavern defined between the top of the receptacle and the bottom end of the first casing;
(r) pulling the liquid fill pipe and the cement fill pipe out of the first casing;
(s) drilling into the cement plug and terminating the drilled hole above the inflated receptacle;
(t) lowering a second casing into the first casing, such that the top end of said casing is at the earth's surface and the bottom end is above the bottom end of the drilled hole;
(u) cementing the second casing to the drilled hole and to the first casing; and
(v) drilling through the cement plug below the bottom end of the second casing until the drill contacts the inflated receptacle and ruptures said receptacle.

3. The method of claim 2 in which the earth cavern is a salt cavern filled with brine having a density of at least 10.2 pounds pe gallon.

4. The method of claim 3 in which the receptacle is a balloon structure, and the balloon structure is filled with brine having a density of about 10.0 pounds per gallon.

5. The method of claim 4 in which the balloon structure is fabricated of a synthetic resin material.

6. The method of claim 2 which includes the steps of:
(a) attaching a weight to the bottom end of the deflated receptacle; and
(b) attaching a weight to the bottom end of the girdle body.

7. Apparatus for setting a cement plug in the shaft of a wide-mouth earth cavern filled with a fluid, which comprises:
(a) an elongate, deflated receptacle, the receptacle is capable of being inflated by filling it with a fluid;
(b) a fluid fill pipe, the fluid fill pipe extends into the deflated receptacle and it has an open end positioned inside the deflated receptacle, to enable the receptacle to be filled with said fluid;
(c) a girdle member which includes a girdle body and a detachable cap fastened to the body, the girdle member, in operating position, encases the deflated receptacle;
(d) means for releasing the girdle member from the deflated receptacle;
(e) a cement fill pipe, the cement fill pipe, in operating position, is positioned adjacent to the fluid fill pipe, and the cement fill pipe has an open end positioned above the receptacle, such that a cement slurry can be delivered into the earth cavern at a point above the deflated receptacle;
(f) a packer tool installed on the fluid fill pipe and cement fill pipe above the girdle member and deflated receptacle, the packer tool is capable of being set against a casing through which the deflated receptacle and girdle member are lowered into the earth cavern.

8. The apparatus of claim 7 in which the deflated receptacle is fabricated of a synthetic resin material.

9. The apparatus of claim 7 in which the girdle release means is a line secured to the detachable girdle cap.

10. The apparatus of claim 7 in which a first weight is attached to the bottom end of the deflated receptacle, and a second weight is attached to the bottom end of the girdle body.

* * * * *